US008216028B2

(12) United States Patent
Lin

(10) Patent No.: US 8,216,028 B2
(45) Date of Patent: Jul. 10, 2012

(54) INSTALLATION/UNINSTALLATION STRUCTURE FOR TOOLING DISK OF A GRINDING TOOL

(75) Inventor: Freddy Lin, Taichung Hsien (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 372 days.

(21) Appl. No.: 12/724,696

(22) Filed: Mar. 16, 2010

(65) Prior Publication Data

US 2011/0230125 A1 Sep. 22, 2011

(51) Int. Cl.
*B24B 41/00* (2006.01)

(52) U.S. Cl. ..... 451/342; 451/359; 451/295; 451/358; 451/353; 451/344

(58) Field of Classification Search ..... 451/359, 451/295, 358, 353, 344, 360, 259, 342; 279/2.23, 279/66, 110, 904
See application file for complete search history.

(56) References Cited

U.S. PATENT DOCUMENTS

| | | | | | |
|---|---|---|---|---|---|
| 2,544,096 | A * | 3/1951 | Laughlin | 451/342 |
| 3,464,165 | A * | 9/1969 | Meredith | 451/342 |
| 3,471,184 | A * | 10/1969 | Herczeg | 403/261 |
| 3,899,852 | A * | 8/1975 | Batson | 451/359 |
| 4,878,316 | A * | 11/1989 | MacKay, Jr. | 451/342 |
| 5,042,207 | A * | 8/1991 | Kirn | 451/342 |
| 5,048,237 | A * | 9/1991 | Lankry | 451/342 |
| 5,058,909 | A * | 10/1991 | Rudolf et al. | 279/8 |
| 5,733,183 | A * | 3/1998 | Schierling et al. | 451/508 |
| 5,775,981 | A * | 7/1998 | Yang | 451/295 |
| 5,964,651 | A * | 10/1999 | Hose | 451/262 |
| 6,752,704 | B1 | 6/2004 | Lin | |
| 6,887,141 | B1 | 5/2005 | Lin | |
| 7,014,548 | B1 | 3/2006 | Lin | |
| 7,128,641 | B1 | 10/2006 | Lin | |
| 7,179,156 | B2 | 2/2007 | Lin | |
| 7,252,580 | B2 | 8/2007 | Lin | |
| 2005/0064803 | A1 * | 3/2005 | Dodds | 451/295 |

* cited by examiner

*Primary Examiner* — George Nguyen
(74) *Attorney, Agent, or Firm* — Guice Patents PLLC

(57) ABSTRACT

An installation/uninstallation structure for tooling disk of a grinding tool includes a rotary shaft mounted in the grinding tool and a securing assembly including a securing seat, a shift plate and a securing member. The securing member is movably mounted in the securing seat. The shift plate is pivotally disposed on the securing seat for driving the securing member. In use, the securing assembly is fitted around a rear end of the rotary shaft, when the shift plate is shifted to a locking position, the securing member is latched with the rotary shaft to secure the securing assembly to the rotary shaft for fixing the tooling disk. When the shift plate is shifted to an unlocking position, the securing member is unlatched from the rotary shaft, permitting a user to detach the securing assembly from the rotary shaft for taking off the tooling disk without using any tool.

20 Claims, 10 Drawing Sheets

INSTALLATION/UNINSTALLATION STRUCTURE FOR TOOLING DISK OF A GRINDING TOOL

BACKGROUND OF THE INVENTION

1. Field of the Invention

The present invention relates generally to a power grinder, and more particularly to an installation/uninstallation structure for tooling disk of a grinder or a sander.

2. Description of the Related Art

A conventional electric or pneumatic grinder includes a grinding wheel/grinding disk mounted on a rotary shaft for grinding a work piece. The grinding wheel is a consumable product and needs to be replaced frequently.

In the conventional grinder, the grinding wheel is fixed at a rear end of the rotary shaft by a nut. When installing/uninstalling the grinding wheel, it is necessary to use one hand tool for holding the rotary shaft and another hand tool for screwing/unscrewing the nut. Therefore, the replacement of the grinding wheel necessitates two hand tools and is quite inconvenient.

Many improved installation/uninstallation structures are disclosed by the inventor in, for example, U.S. Pat. No. 7,014,548, U.S. Pat. No. 7,179,156, U.S. Pat. No. 7,128,641, U.S. Pat. No. 6,887,141, etc. In the improved installation/uninstallation structure, an engaging means is disposed in the grinding tool for locking the rotary shaft and hindering the rotary shaft from rotating. In this case, the grinding wheel can be installed/uninstalled with only one hand tool.

In such improved installation/uninstallation structure, the rotary shaft can be locked with the engaging means so that an operator can more conveniently replace the grinding wheel. However, the operator still needs to use one hand tool for screwing/unscrewing the screw member. In this case, it still takes some time to complete the replacement of the grinding wheel.

Moreover, the engaging means is mounted in the body of the grinding tool and has a complicated structure. In addition, it is hard to assemble the engaging means so that the manufacturing cost is increased.

SUMMARY OF THE INVENTION

It is therefore a primary object of the present invention to provide an installation/uninstallation structure for tooling disk of a grinding tool. By means of the installation/uninstallation structure, a user can more easily replace the tooling disk without using any hand tool.

It is a further object of the present invention to provide the above installation/uninstallation structure for the tooling disk of the grinding tool. By means of the installation/uninstallation structure, a user can more quickly replace the tooling disk.

It is still a further object of the present invention to provide the above installation/uninstallation structure for the tooling disk of the grinding tool. The installation/uninstallation structure is applicable to the grinding tool as an external device without changing the internal structure of the grinding tool.

To achieve the above and other objects, the installation/uninstallation structure for the tooling disk of the grinding tool of the present invention includes a rotary shaft mounted in the grinding tool and a securing assembly mounted on the rotary shaft. An annular groove is formed on a circumference of the rear end of the rotary shaft. The securing assembly includes a securing seat, a shift plate and a securing member. The securing seat has a through hole and a slide way. The securing member is slidably mounted in the slide way of the securing seat. The shift plate is pivotally disposed on the securing seat and movable between a locking position and an unlocking position. When shifting the shift plate, the shift plate drives the securing member to move within the slide way.

The securing assembly is fitted on the rear end of the rotary shaft. When the shift plate is shifted to the locking position, the shift plate drives the securing member to move toward an inner end of the slide way and makes an inner end of the securing member move into the through hole of the securing seat to be latched in the annular groove of the rotary shaft. At this time, the securing assembly is secured to the rotary shaft for fixing the tooling disk. When the shift plate is shifted to the unlocking position, the shift plate drives the securing member to move toward an outer end of the slide way and makes the inner end of the securing member move out of the annular groove and the securing member is released from the rotary shaft. In this case, the securing assembly can be detached from the rotary shaft for taking off the tooling disk.

As a result, the tooling disk can be replaced more easily and quickly without using any hand tool.

The present invention can be best understood through the following description and accompanying drawings, wherein:

DETAILED DESCRIPTION OF THE PREFERRED EMBODIMENT

Figure 1:
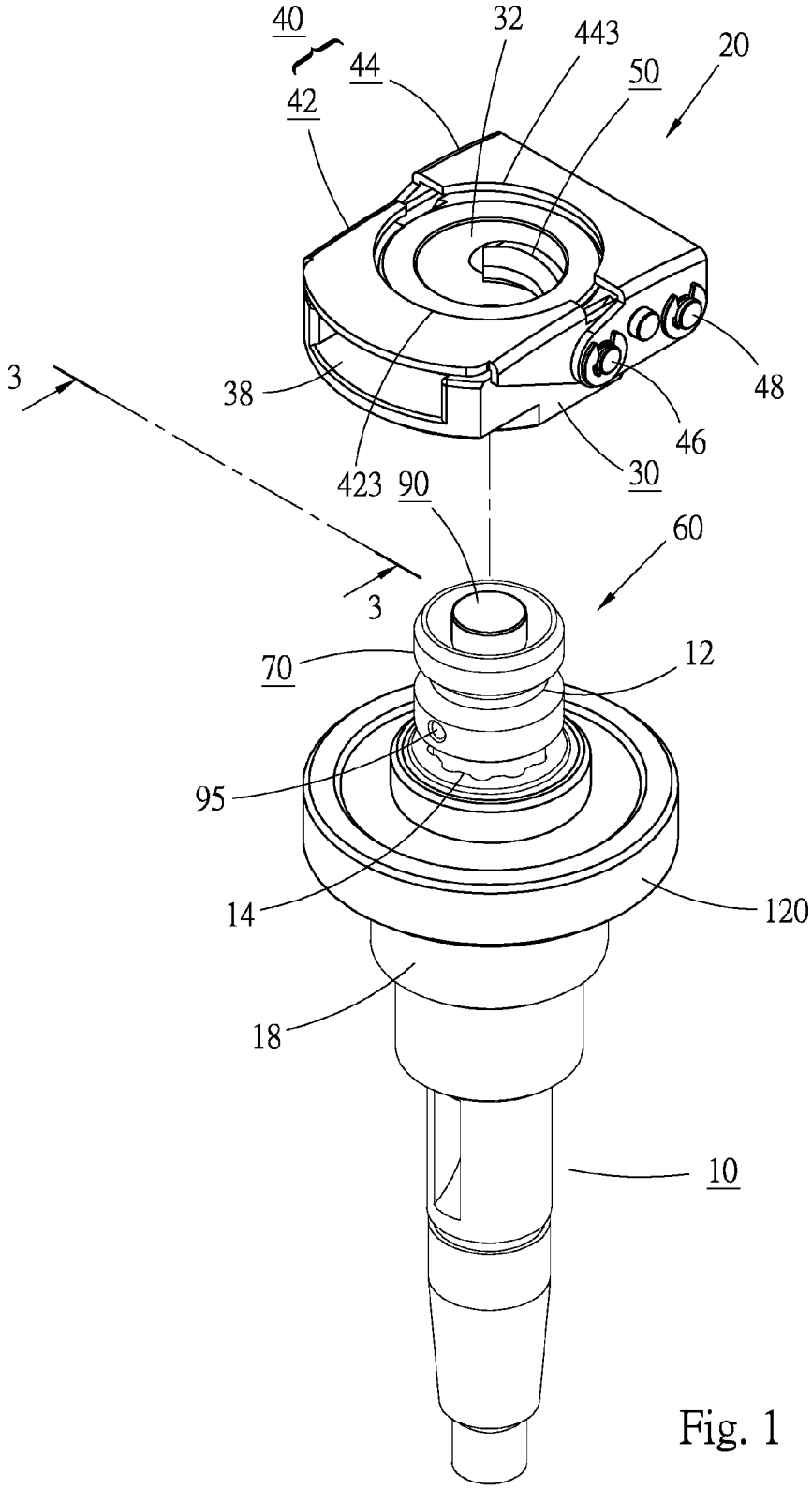
FIG. 1 is a perspective view of a preferred embodiment of the present invention, in which the securing assembly is in a locking state.
Figure 2:
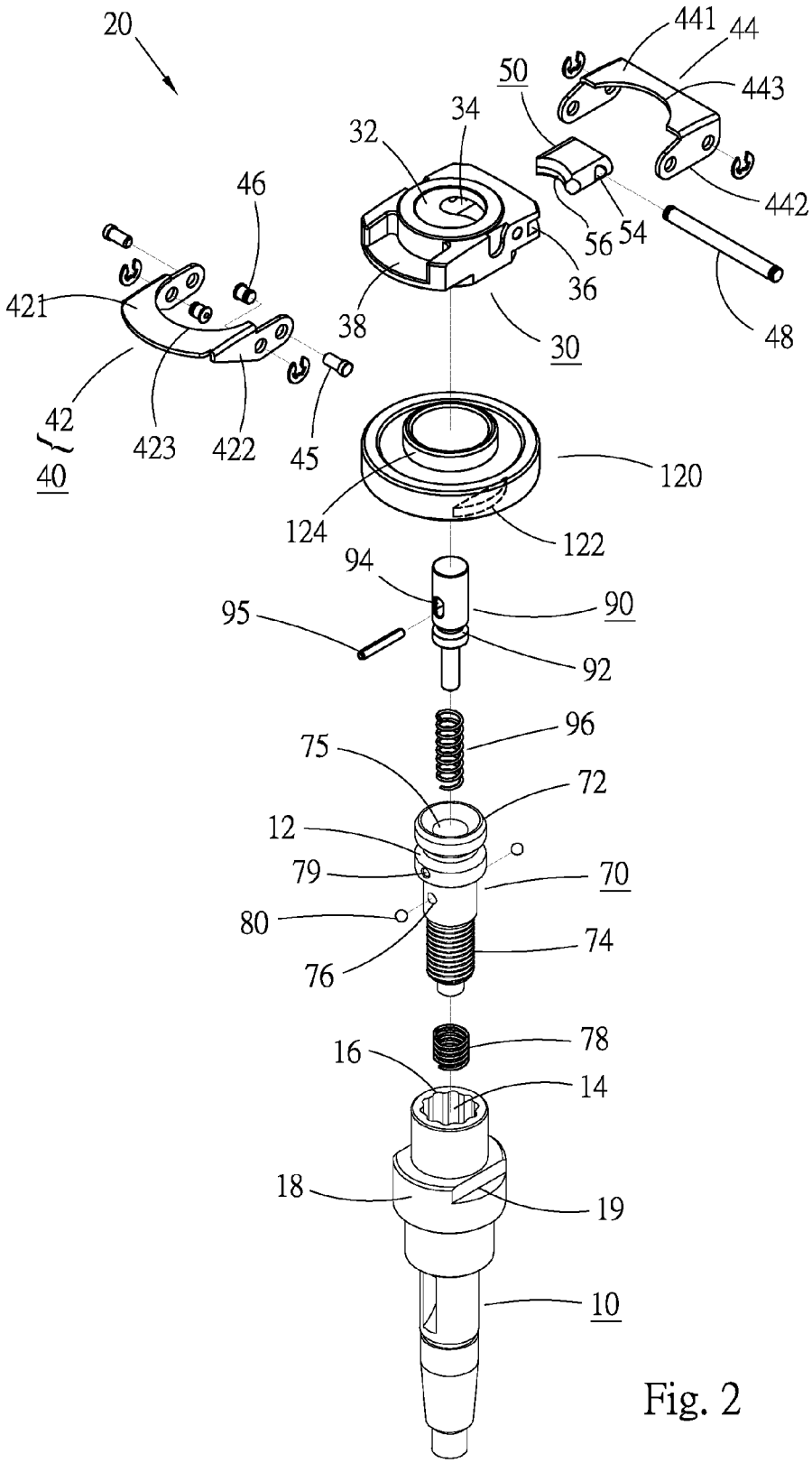
FIG. 2 is a perspective exploded view according to FIG. 1.

Please refer to FIGS. 1 and 2. According to a preferred embodiment, the installation/uninstallation structure for the tooling disk of the present invention is applied to a grinding tool, for example, a pneumatic or electric grinder, a pneumatic or electric sander, a pneumatic or electric polisher, etc., for replacing the tooling disk such as a grinding wheel/grinding disk or a polishing disk.

The present invention comprises a rotary shaft 10 mounted on a grinding tool and a securing assembly 20. For easy illustration, the rotary shaft 10 is shown in FIGS. 1 and 2 with its bottom end (rear end) directed upward.

Figure 7:
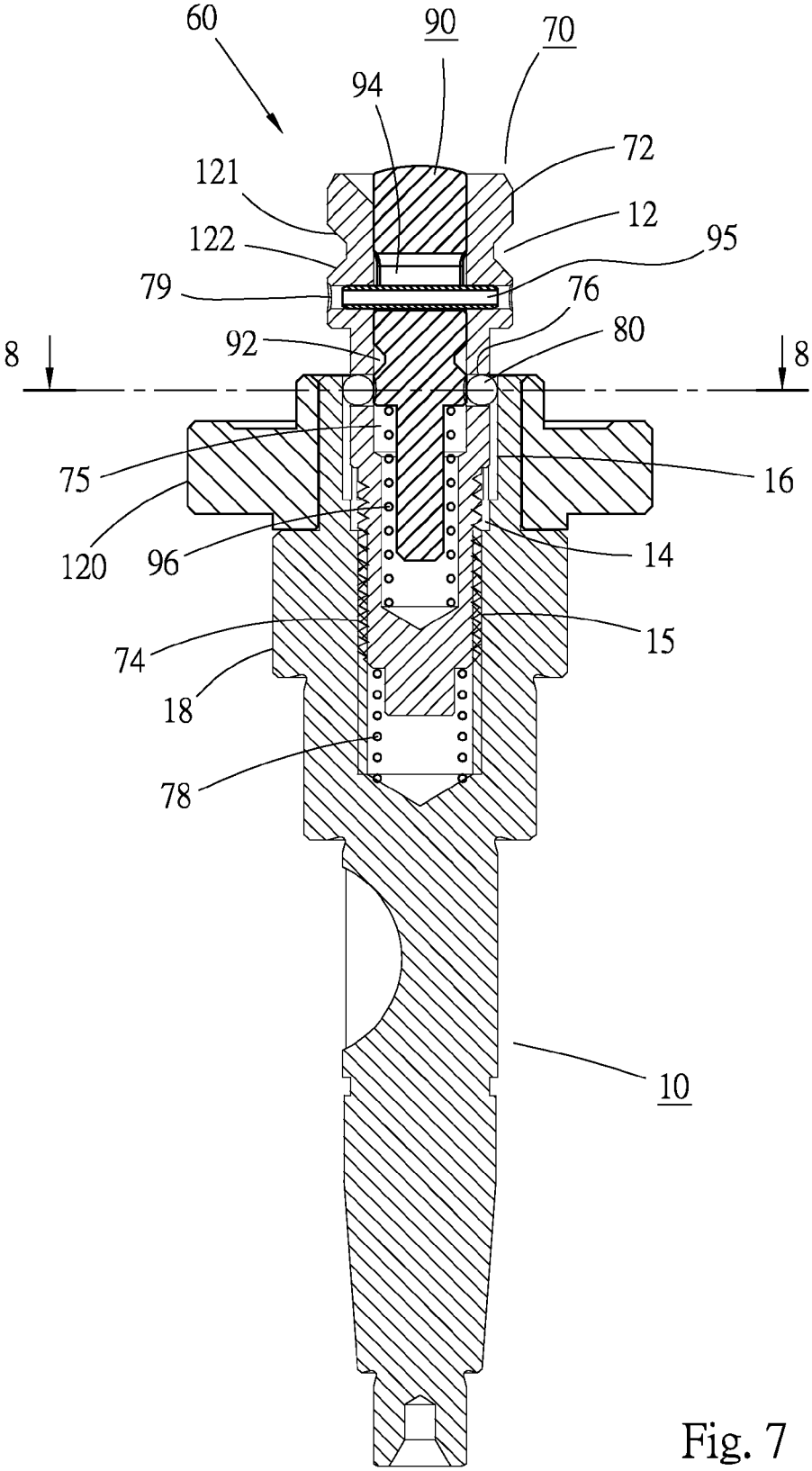
FIG. 7 is a longitudinal sectional view of the preferred embodiment of the present invention, showing the rotary shaft thereof.

The rear end of the rotary shaft 10 has a circumference on which an annular groove 12 is formed. The annular groove 12 has a beveled top wall 121 and a beveled bottom wall 122 as shown in FIG. 7.

The securing assembly 20 includes a securing seat 30, a shift plate 40 and a securing member 50.

The securing seat 30 has a through hole 32 passing through the securing seat 30 from a top face to a bottom face thereof, and a slide way 34 radially formed on a rear side of the securing seat 30. An inner end of the slide way 34 communicates with the through hole 32. An outer end of the slide way 34 is formed as a slot 36 passing through the securing seat between two lateral sides thereof. A recess 38 is formed at a front end of the securing seat 30.

Figure 3:
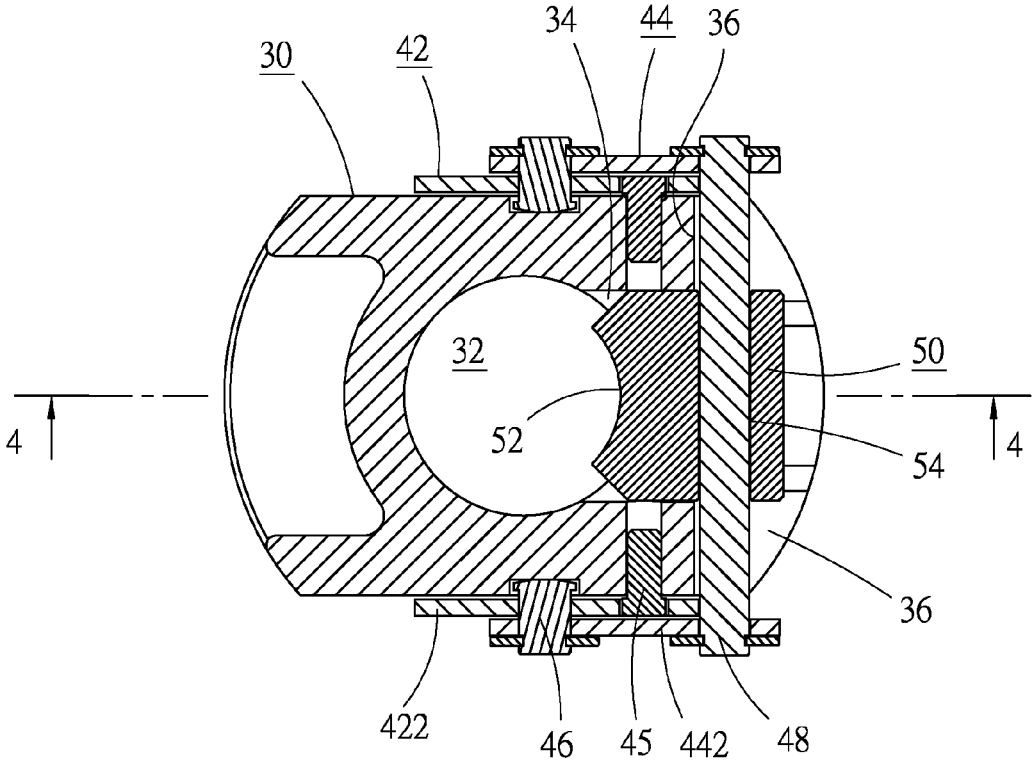
FIG. 3 is a sectional view taken along line 3-3 of FIG. 1, showing the securing assembly of the present invention.
Figure 4:
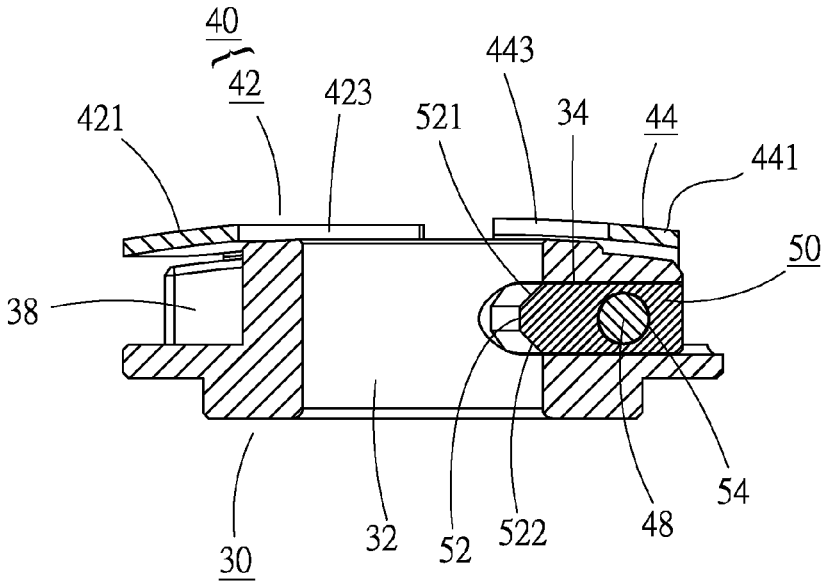
FIG. 4 is a sectional view taken along line 4-4 of FIG. 3.

The securing member 50 is mounted in the slide way 34 as shown in FIGS. 3 and 4, and is slidable along the slide way 34. The securing member 50 has a front end, which is an inward arcuate abutment end 52. The securing member 50 further has a rear end formed with a transverse passage 54. The abutment end 52 has a beveled top edge 521 and a beveled bottom edge 522 as shown in FIG. 4.

In this embodiment, the shift plate 40 includes a front piece 42 and a rear piece 44 pivotally connected with each other to form a linking mechanism. The front piece 42 has a top wall 421 and two lateral walls 422. Rear ends of the lateral walls 422 are pivotally connected to two lateral sides of the securing seat 30 via pivot shafts 45 as shown in FIG. 3, whereby the front piece 42 can be rotated. Front ends of two lateral walls 442 of the rear piece 44 are respectively pivotally connected to the two lateral walls 422 of the front piece 42 via pivot shafts 46. The movable pivot points, (that is, the pivot shafts 46), are positioned in front of the fixed pivot points, (that is, the pivot shafts 45). A rear end of the rear piece 44 is connected to the securing member 50 via a link 48. The link 48 passes through the passage 54 of the securing member 50. Two ends of the link 48 extend out from the slot 36 toward two lateral sides of the securing seat 30 to pivotally connect with the two lateral walls 442 of the rear piece 44.

Figure 5:
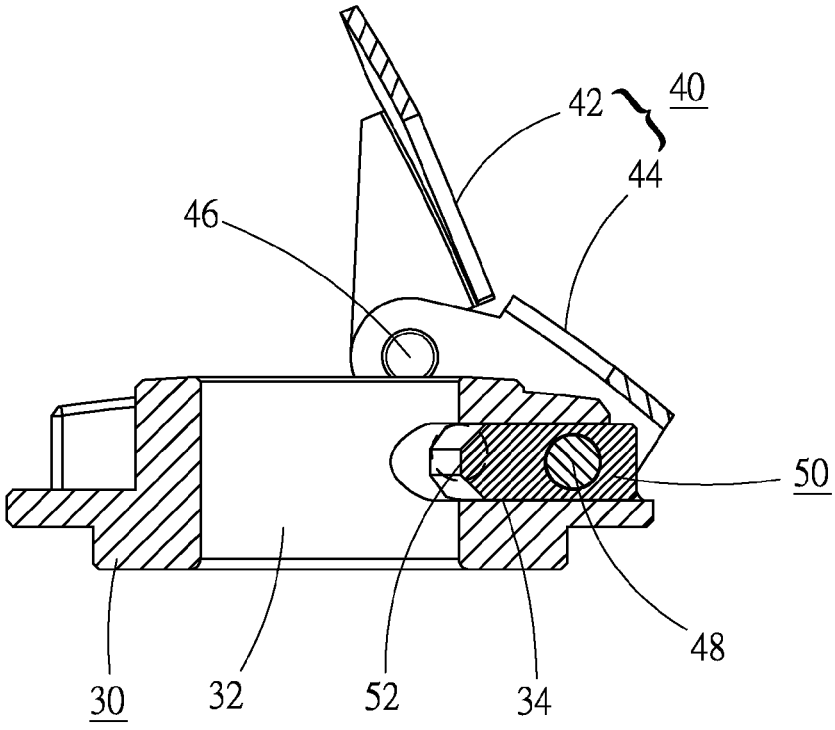
FIG. 5 is a sectional view of the securing assembly of the present invention, in which the securing assembly is in an unlocking state.

The shift plate 40 can be shifted to a locking position as shown in FIG. 1 and attached to the securing seat 30 or turned upward to an unlocking position as shown in FIG. 5. When the securing assembly 20 is in a locking state, the front piece 42 and rear piece 44 of the shift plate 40 serves as a linking mechanism for driving the link 48 to move forward within the slot 36. At this time, the link 48 urges the securing member 50 to move toward the inner end of the slide way 34 and makes the abutment end 52 of the securing member 50 move into the through hole 32 of the securing seat 30 as shown in FIGS. 3 and 4. When the securing assembly 20 is in an unlocking state, the shift plate 40 drives the link 48 and the securing member 50 to move rearward, whereby the securing member 50 is moved out of the through hole 32 as shown in FIG. 5.

Figure 6:
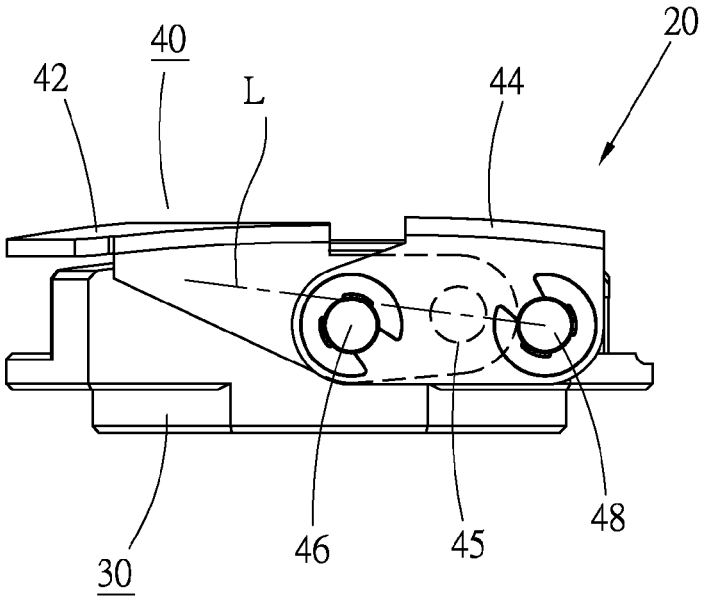
FIG. 6 is a side view of the securing assembly of the present invention.

Referring to FIG. 6, in the locking state, a line L is formed between a center of the fixed pivot point, (that is, the pivot shaft 45) and a center of the link 48; a center of the movable pivot point, (that is, the pivot shaft 46), between the front and rear pieces 42, 44 is lower than the line L. This ensures that the shift plate 40 keeps in the locking position. The shift plate 40 can be shifted to the unlocking position only by means of applying an external force to the shift plate 40. Therefore, the securing assembly can stably keep in the locking state without loosening. The recess 38 formed at the front end of the securing seat 30 permits a user's finger to conveniently shift the front piece 42.

In addition, the top walls 421, 441 of the front and rear pieces 42, 44 are respectively formed with semicircular notches 423, 443. When the shift plate 40 is positioned in the locking position, the two notches 423, 443 together form a circular perforation in alignment with the through hole 32 of the securing seat 30. Accordingly, the through hole 32 will not be blocked by the shift plate.

Figure 8:
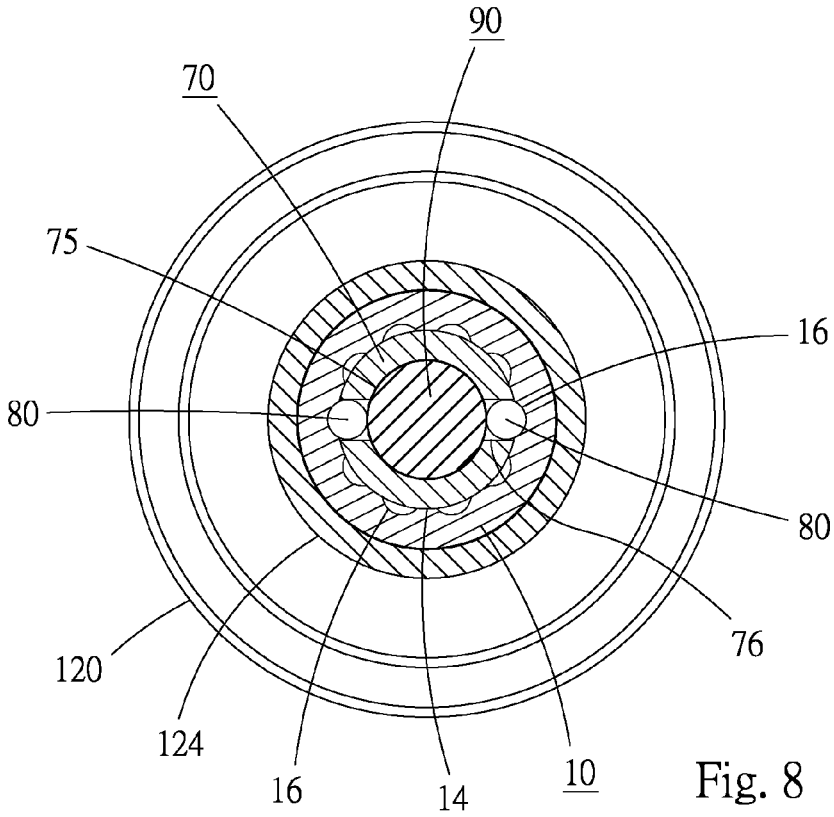
FIG. 8 is a sectional view taken along line 8-8 of FIG. 7.

In the present invention, a height adjustment mechanism 60 is further disposed in the rotary shaft 10. Referring to FIGS. 2 and 7, the rear end of the rotary shaft 10 is formed with an axial cylindrical socket 14. A blind threaded hole 15 is further formed at a bottom end of the socket 14. Referring to FIG. 8, multiple longitudinal splineways 16 are formed on a circumferential wall of the socket at equal intervals.

The height adjustment mechanism 60 includes an adjustment rod 70, two engaging members 80 and a press member 90.

The adjustment rod 70 is a stepped cylindrical rod, having a top end as a head section 72. An outer circumference of the adjustment rod 70 is formed with an outer thread 74. A cavity 75 is formed on the top end of the adjustment rod 70. Two apertures 76 are radially formed through a tubular wall of the adjustment rod 70 in communication with the cavity 75. The adjustment rod 70 is mounted in the socket 14 of the rotary shaft 10 and screwed into the threaded hole 15 with the head section 72 protruding from the rear end of the rotary shaft 10. When rotating the adjustment rod, the length of a section of the adjustment rod that protrudes from the rotary shaft can be adjusted. The aforesaid annular groove 12 is formed on a circumference of the head section 72. A first resilient member 78, which is a spring, is mounted in the threaded hole 15. A top end of the resilient member 78 resiliently abuts against an inner end of the adjustment rod 70.

The two engaging members 80 can be steel balls, which are respectively mounted in the apertures 76.

The press member 90 also has the form of a rod. An annular recess 92 is formed on a circumference of the press member 90. In addition, a restriction slot 94 is radially formed through the press member 90. The restriction slot 94 longitudinally extends along the axis of the press member 90. The press member 90 is mounted in the cavity 75 of the adjustment rod 70 and slidable along the cavity 75. A restriction pin 95 is radially fitted in pinholes 79 of the adjustment rod and pass through the restriction slot of the press member 90. Accordingly, the press member is movable by a distance limited within a range without being extracted out of the cavity 75 of the adjustment rod 70. A second resilient member 96 is mounted in the cavity 75 of the adjustment rod 70 in abutment with the press member 90. The second resilient member 96 exerts a resilient force on the press member 90 to normally keep the press member 90 in an upper dead end where there is a drop between the annular recess 92 of the press member and the engaging members 80. Referring to FIG. 8, the circumference of the press member 90 pushes the two engaging members 80 outward and makes the engaging members 80 protrude from the adjustment rod 70 and engage in the splineways 16 of the rotary shaft 10. Under such circumstance, the adjustment mechanism 60 is engaged with the rotary shaft 10 and synchronously rotatable therewith.

Figure 10:
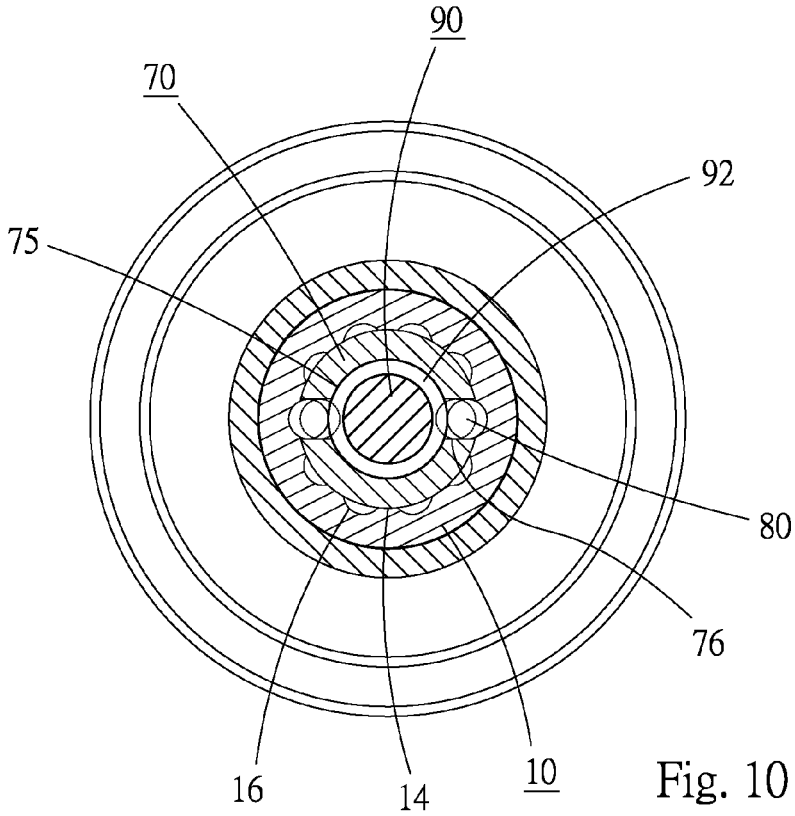
FIG. 10 is a sectional view taken along line 10-10 of FIG. 9.
Figure 9:
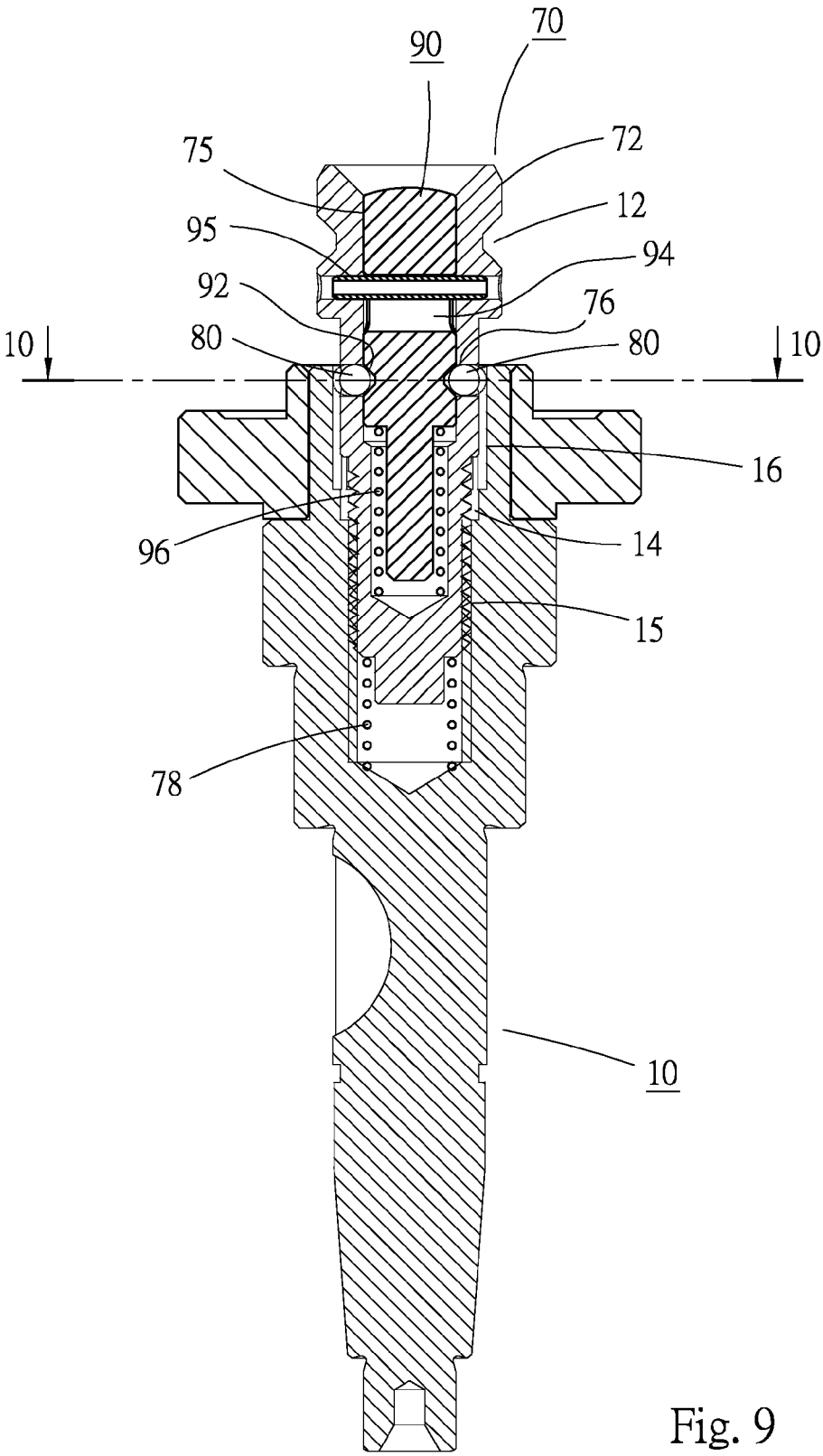
FIG. 9 is a longitudinal sectional view according to FIG. 7, showing the operation of the height adjustment mechanism of the present invention.

Referring to FIG. 9, when adjusting the protruding length of the adjustment rod 70, a user can press down the press member 90 and move the annular recess 92 of the press member 90 downward to a position flush with the engaging members 80. In this case, the engaging members are no longer urged by the circumference of the press member and the annular recess 92 provides a retraction space for the engaging members 80 as shown in FIG. 10. Therefore, the engaging members can be moved into the apertures 76 of the adjustment rod 70 and disengaged from the splineways 16. At this time, the user can rotate the adjustment rod 70 to make the head section 72 thereof more protrude from the rear end of the rotary shaft 10 or more retracted into the rear end of the rotary shaft 10.

Figure 11:
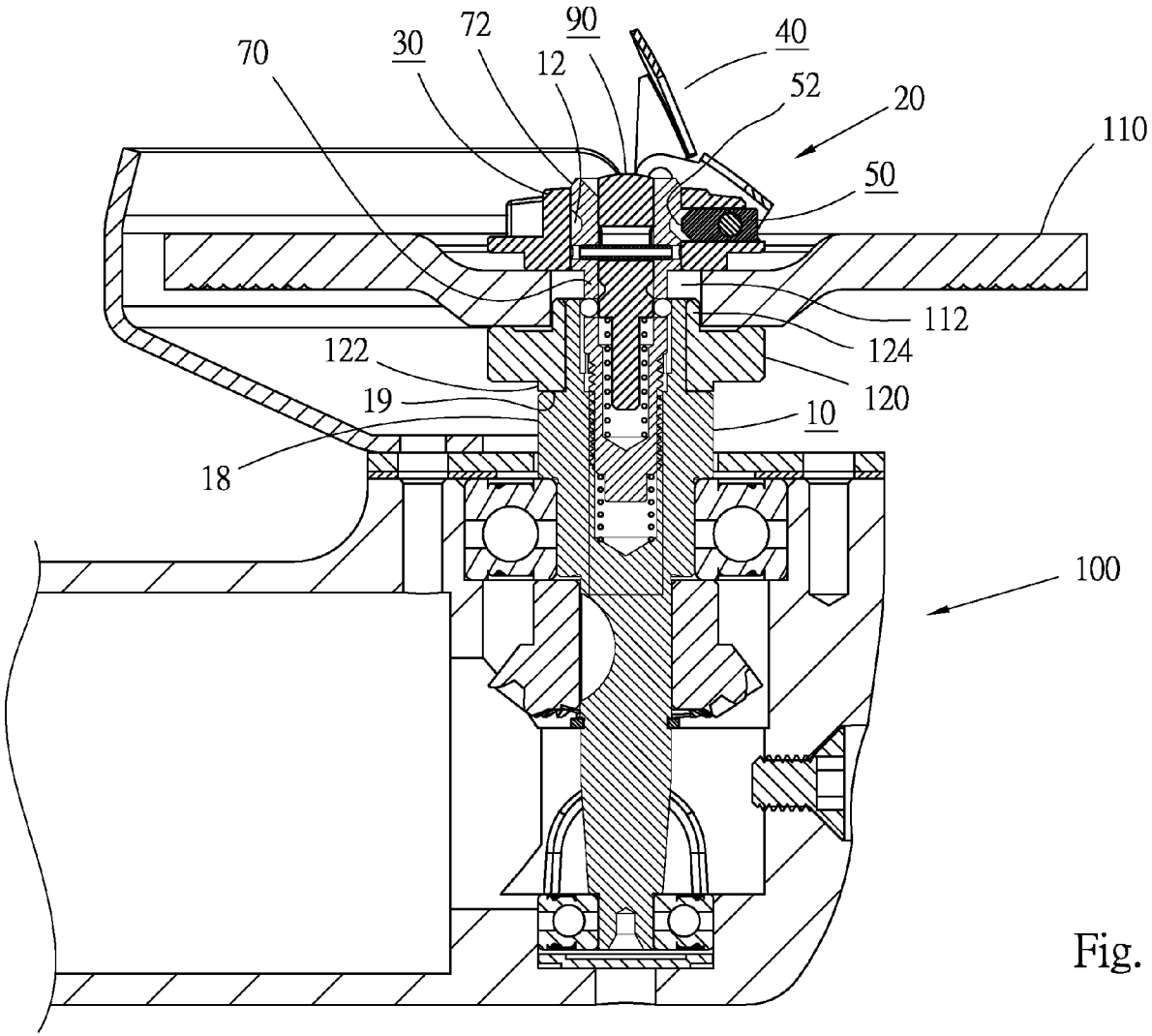
FIGS. 11 and 12 show that a tooling disk is installed on and secured to a grinding tool by means of the present invention.

Please refer to FIG. 11. The present invention is applicable to, but not limited to, a grinding tool 100 for fixing a tooling disk 110 thereon. The rotary shaft 10 is mounted in the grinding tool 100 and drivable by a drive unit (not shown). Referring to FIG. 2, the rotary shaft 10 is stepped and has a large-diameter section 18. An end face of the large-diameter section that is proximal to the rear end of the rotary shaft is formed with two cuts 19. The rotary shaft 10 further includes a gasket 120, which is a ring-shaped body with a predetermined thickness. Two raised blocks 122 are disposed on one end face of the gasket 120, while a flange 124 is disposed on the other end face of the gasket 120. The gasket 120 is fitted around the rotary shaft 10 with the raised blocks 122 engaged with the cuts 19, whereby the gasket is synchronously rotatable with the rotary shaft.

Figure 12:
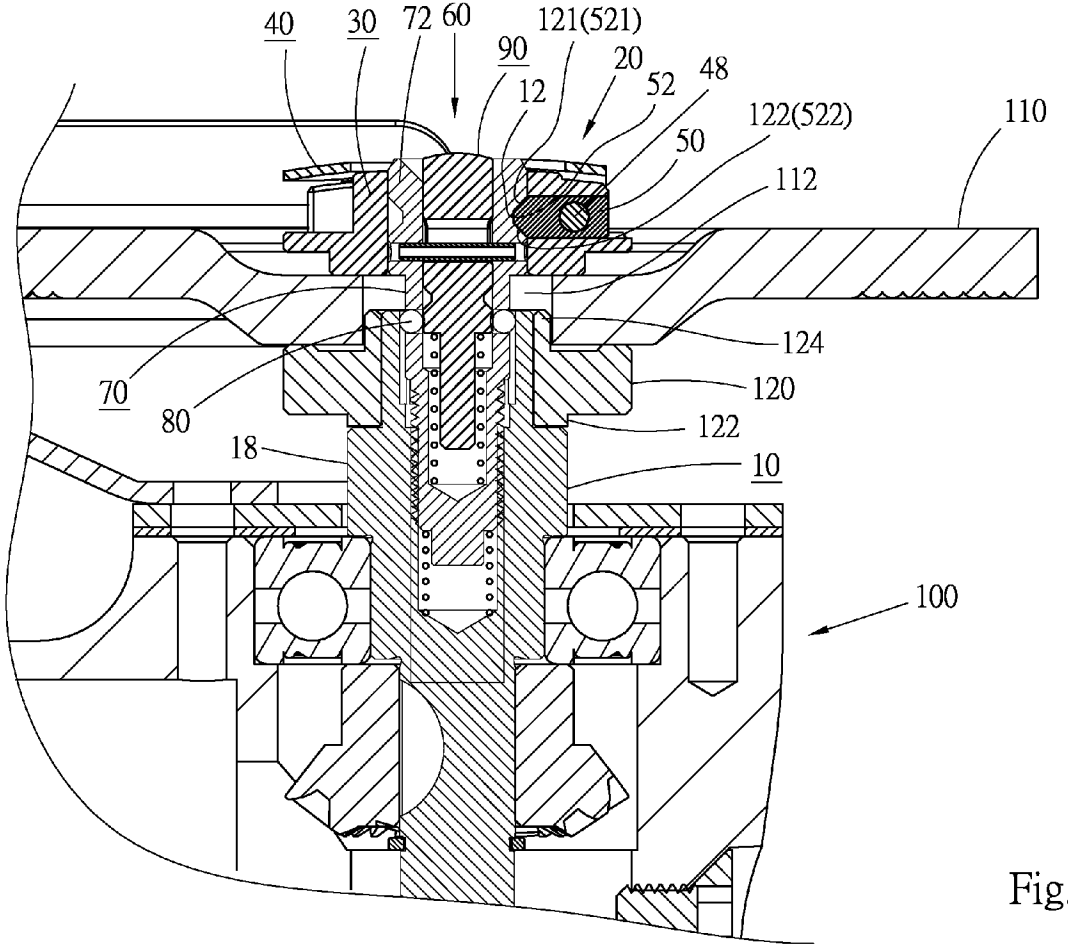

When installing the tooling disk, on the basis of the direction of FIG. 11, the tooling disk 110 is fitted around the rotary shaft 10 with a bottom face of the tooling disk attaching to the gasket 120. The flange 124 of the gasket 120 is fitted in a circular hole 112 of the tooling disk 110. Then the securing assembly 20 is mounted at the rear end of the rotary shaft 10 in an unlocking state as shown in FIG. 5. The head section 72 of the adjustment rod 70 is fitted in the through hole 32 of the securing seat 30. Then the shift plate 40 is shifted to the locking position to convert the securing assembly 20 into the locking state as shown in FIG. 12. At this time, the abutment end 52 of the securing member 50 is moved into the through hole 32 of the securing seat 30 and latched in the annular groove 12 of the rotary shaft. Under such circumstance, the tooling disk 110 is securely clamped between the securing assembly 20 and the gasket 120.

As aforesaid, the annular groove 12 has a beveled top wall 121 and a beveled bottom wall 122, and the abutment end 52 has a beveled top edge 521 and a beveled bottom edge 522. The beveled top wall 121 and beveled bottom wall 122 serve to guide the beveled top edge 521 and beveled bottom edge 522, whereby the abutment end 52 can be moved into the annular groove 12 and engaged therein as tightly as possible. On the other hand, the securing assembly 20 can be automatically adjusted to an optimal height/position for clamping the tooling disk.

Due to different tooling disks have different thickness, an operator can adjust the protruding length of the adjustment rod 70 so as to change the gap between the annular groove 12 and the gasket 120 in accordance with the thickness of the tooling disk. Accordingly, the present invention is applicable to various tooling disks with different thickness. The adjustment process is as shown in FIGS. 7 to 10, the press member 90 is pressed down to disengage the engaging members 80 from the splineways 16 of the rotary shaft 10, whereby the adjustment rod 70 can be rotated to adjust the gap.

Figure 13:
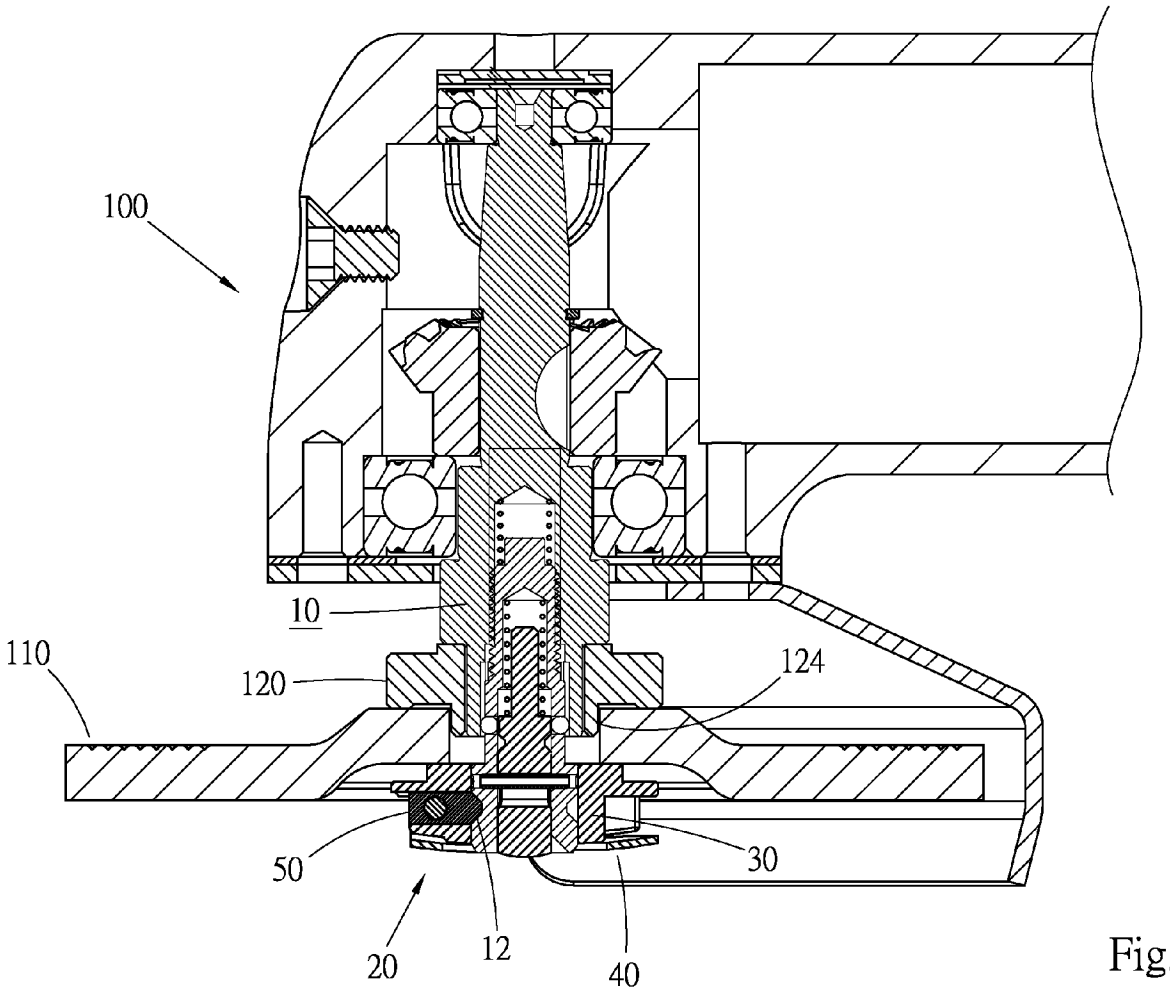
FIG. 13 shows the use of the grinding tool.

Please refer to FIG. 13. When using the grinding tool 100, the rear end of the rotary shaft 10 is directed to a work piece for grinding or polishing the work piece with the tooling disk 110. The rotary shaft and the tooling disk are clockwise rotated. According to right-hand principle, the angular momentum of the tooling disk 110 is directed to the securing assembly 20. Accordingly, the angular momentum of the tooling disk keeps the tooling disk rotating with the securing assembly in tight contact therewith. As aforesaid, the securing assembly 20 can stably keep in the locking state without loosening from the rotary shaft. Thanks to the angular momentum of the tooling disk and the stable locking state of the securing assembly 20, the securing assembly can firmly secure the tooling disk to the rotary shaft.

When detaching the tooling disk, an operator only needs to shift the securing assembly 20 to the unlocking state as shown in FIG. 11. In this case, the securing member 50 is unlatched from the annular groove 12, permitting the operator to easily and quickly take off the securing assembly and the tooling disk from the rotary shaft.

According to the above arrangement, an operator can replace the tooling disk without using any tool. The operator only needs to shift the securing assembly between the locking state and the unlocking state to replace the tooling disk.

In contrast, the conventional engaging means is installed in the body of a grinding tool for engaging with the rotary shaft, permitting an operator to install/uninstall a tooling disk with a hand tool; the present invention provides a replacement measure, which is totally different from the traditional replacement measure. The present invention is free from any engaging means for fixing the rotary shaft. By means of the present invention, an operator can replace the tooling disk without using any hand tool.

Through a real test performed by this applicant, it is proved that the tooling disk can be effectively secured to the rotary shaft and rotated therewith. The replacement of the tooling disk can be conveniently and quickly completed in seconds.

The present invention has a simple structure and is applicable to the grinding tool as an external device without changing the internal structure of the grinding tool. In addition, the present invention is easy to manufacture at lower cost.

The above embodiment is only used to illustrate the present invention, not intended to limit the scope thereof. Many modifications of the above embodiment can be made without departing from the spirit of the present invention. For example, the securing plate can be a one-piece component instead of the front and rear pieces of the above embodiment, and the one-piece securing plate can be latched with or unlatched from the securing seat.

What is claimed is:

1. An installation/uninstallation structure for tooling disk of a grinding tool, comprising a rotary shaft mounted in a grinding tool and a securing assembly, wherein:

the rotary shaft has a rear end, an annular groove being formed on a circumference of the rear end of the rotary shaft;

the securing assembly includes a securing seat, a shift plate and a securing member;

the securing seat having a through hole passing through the securing seat from a top face to a bottom face thereof; a slide way being radially formed on a rear side of the securing seat, an inner end of the slide way communicating with the through hole;

the shift plate being pivotally disposed on the securing seat and movable between a locking position and an unlocking position;

the securing member being mounted in the slide way of the securing seat and slidable within the slide way, the securing member having a front end as an abutment end; the securing member being connected with the shift plate by means of a link, whereby when shifting the shift plate, the shift plate via the link drives the securing member to move within the slide way; and the securing assembly being fitted on the rear end of the rotary shaft with the rotary shaft passing through the through hole of the securing seat; when the shift plate is shifted to the locking position, the shift plate driving the securing member to move toward an inner end of the slide way and making the abutment end of the securing member move into the through hole to be latched in the annular groove of the rotary shaft, whereby the securing assembly is secured to the rotary shaft for fixing the tooling disk; when the shift plate is shifted to the unlocking position, the shift plate driving the securing member to move toward an outer end of the slide way and making the abutment end of the securing member move out of the annular groove, whereby the securing assembly can be detached from the rotary shaft for taking off the tooling disk.

2. The installation/uninstallation structure for the tooling disk as claimed in claim 1, wherein the shift plate includes a front piece and a rear piece, the front piece having two lateral walls, which are pivotally connected to two lateral sides of the securing seat, whereby the front piece can be rotated; the rear piece also having two lateral walls, which are pivotally connected to the two lateral walls of the front piece; two ends of the link being connected to rear ends of the two lateral walls of the rear piece.

3. The installation/uninstallation structure for the tooling disk as claimed in claim 1, wherein the annular groove has a beveled top wall and a beveled bottom wall.

4. The installation/uninstallation structure for the tooling disk as claimed in claim 2, wherein the annular groove has a beveled top wall and a beveled bottom wall.

5. The installation/uninstallation structure for the tooling disk as claimed in claim 2, wherein where the front piece of the shift plate and the securing seat pivotally connected is a fixed pivot point and where the front piece and the rear piece pivotally connected is a movable pivot point; when the securing assembly is in a locking state, a line is formed between a center of the fixed pivot point and a center of the link, a center of the movable pivot point is lower than the line.

6. The installation/uninstallation structure for the tooling disk as claimed in claim 1, wherein the abutment end of the securing member has a beveled top edge and a beveled bottom edge.

7. The installation/uninstallation structure for the tooling disk as claimed in claim 5, wherein the abutment end of the securing member has a beveled top edge and a beveled bottom edge.

8. The installation/uninstallation structure for the tooling disk as claimed in claim 1, wherein the securing member has a rear end formed with a transverse passage; a body of the link being passed through the passage of the securing member.

9. The installation/uninstallation structure for the tooling disk as claimed in claim 8, wherein a rear end of securing seat is formed with a slot passing through the securing seat between two lateral sides thereof, the slot communicating with the slide way; two ends of the link extending out from the slot toward two lateral sides of the securing seat to connect with two lateral sides of the shift plate.

10. The installation/uninstallation structure for the tooling disk as claimed in claim 2, wherein the front piece has a top wall and the rear piece also has a top wall; two notches being respectively formed on the top walls of the front and rear pieces, whereby when the shift plate is positioned in the locking position, the two notches together form a perforation in alignment with the through hole of the securing seat.

11. The installation/uninstallation structure for the tooling disk as claimed in claim 1, wherein the rear end of the rotary shaft is formed with an axial cylindrical socket; further comprising:

a height adjustment mechanism including an adjustment rod, the adjustment rod having a top end as a head section, the adjustment rod being disposed in the socket with the head section protruding out from the rear end of the rotary shaft, the length of a section of the adjustment rod that protrudes from the rear end of the rotary shaft being adjustable; the annular groove being formed on a circumference of the head section of the adjustment rod.

12. The installation/uninstallation structure for the tooling disk as claimed in claim 2, wherein the rear end of the rotary shaft is formed with an axial cylindrical socket; further comprising:

a height adjustment mechanism including an adjustment rod, the adjustment rod having a top end as a head section, the adjustment rod being disposed in the socket with the head section protruding out from the rear end of the rotary shaft, the length of a section of the adjustment rod that protrudes from the rear end of the rotary shaft being adjustable; the annular groove being formed on a circumference of the head section of the adjustment rod.

13. The installation/uninstallation structure for the tooling disk as claimed in claim 11, wherein a blind threaded hole is further formed at a bottom end of the socket of the rotary shaft; multiple splineways being formed on a circumferential wall of the socket at intervals;

the height adjustment mechanism including the adjustment rod, at least one engaging member and a press member, wherein:

the adjustment rod is screwed in the threaded hole; a cavity being formed on the top end of the adjustment rod; at least one aperture being radially formed through a circumference of the adjustment rod in communication with the cavity;

the engaging member is disposed in the aperture; and the press member has the form of a rod, an annular recess being formed on a circumference of the press member, the press member being disposed in the cavity and movable along the cavity between an upper dead end and a lower dead end; a resilient member being positioned between the adjustment rod and the press member for resiliently pushing the press member upward and normally keeping the press member in the upper dead end where there is a drop between the annular recess of the press member and the engaging member; the circumference of the press member pushing the engaging member outward and making the engaging member protrude from the adjustment rod to engage in one of the splineways of the rotary shaft, when pressing the press member to move the annular recess of the press member to a position flush with the engaging member, the engaging member being no longer outward pushed by the press member, whereby the engaging member can be moved into the aperture of the adjustment rod, permitting the adjustment rod to be rotated.

14. The installation/uninstallation structure for the tooling disk as claimed in claim 12, wherein a blind threaded hole is further formed at a bottom end of the socket of the rotary shaft; multiple splineways being formed on a circumferential wall of the socket at intervals;

the height adjustment mechanism including the adjustment rod, at least one engaging member and a press member, wherein:

the adjustment rod is screwed in the threaded hole; a cavity being formed on the top end of the adjustment rod; at least one aperture being radially formed through a circumference of the adjustment rod in communication with the cavity;

the engaging member is disposed in the aperture; and the press member has the form of a rod, an annular recess being formed on a circumference of the press member, the press member being disposed in the cavity and movable along the cavity between an upper dead end and a lower dead end; a resilient member being positioned between the adjustment rod and the press member for resiliently pushing the press member upward and normally keeping the press member in the upper dead end where there is a drop between the annular recess of the press member and the engaging member; the circumference of the press member pushing the engaging member outward and making the engaging member protrude from the adjustment rod to engage in one of the splineways of the rotary shaft, when pressing the press member to move the annular recess of the press member to a position flush with the engaging member, the engaging member being no longer outward pushed by the press member, whereby the engaging member can be moved into the aperture of the adjustment rod, permitting the adjustment rod to be rotated.

15. The installation/uninstallation structure for the tooling disk as claimed in claim 14, wherein where the front piece of the shift plate and the securing seat pivotally connected is a fixed pivot point and where the front piece and the rear piece pivotally connected is a movable pivot point; when the securing assembly is in a locking state, a line is formed between a center of the fixed pivot point and a center of the link, a center of the movable pivot point is lower than the line.

16. The installation/uninstallation structure for the tooling disk as claimed in claim 13, wherein a restriction slot is radially formed through the press member, the restriction slot longitudinally extending along an axis of the press member; a restriction pin being radially fitted in pinholes of the adjustment rod to pass through the restriction slot of the press member.

17. The installation/uninstallation structure for the tooling disk as claimed in claim 13, wherein a resilient member is mounted in the threaded hole, the resilient member resiliently abuts against an inner end of the adjustment rod.

18. The installation/uninstallation structure for the tooling disk as claimed in claim 1, further comprising a gasket, which is a ring-shaped body, the gasket being fitted around the rotary shaft and engaged with the rotary shaft and synchronously rotatable therewith; the tooling disk being positioned between the gasket and the securing assembly.

19. The installation/uninstallation structure for the tooling disk as claimed in claim 18, wherein a flange being disposed on a top end face of the gasket, the flange being fitted in a hole of the tooling disk.

20. The installation/uninstallation structure for the tooling disk as claimed in claim 13, wherein the rotary shaft has a large-diameter section; further comprising a gasket, which is a ring-shaped body, a flange being disposed on a top end face of the gasket, the gasket being fitted around the rotary shaft and located on the large-diameter section, a bottom end face of the gasket being engaged with the large-diameter section, the tooling disk being positioned between the gasket and the securing assembly; the flange of the gasket being fitted in a circular hole of the tooling disk.

* * * * *